US008133309B2

(12) United States Patent
Smith et al.

(10) Patent No.: US 8,133,309 B2
(45) Date of Patent: Mar. 13, 2012

(54) TURBOMACHINE FILTER SYSTEM HAVING A DRAIN WITH ONE-WAY VALVE

(75) Inventors: Christopher James Smith, Worthing (GB); Marcus Carr Walters, Ash Green (GB); John Howard Furse, La Grange, KY (US)

(73) Assignee: General Electric Company, Schenectady, NY (US)

( * ) Notice: Subject to any disclaimer, the term of this patent is extended or adjusted under 35 U.S.C. 154(b) by 898 days.

(21) Appl. No.: 12/173,960

(22) Filed: Jul. 16, 2008

(65) Prior Publication Data

US 2010/0012562 A1 Jan. 21, 2010

(51) Int. Cl.
*B01D 46/42* (2006.01)

(52) U.S. Cl. ..... 96/412; 55/423; 55/DIG. 17; 60/339; 96/408; 417/434

(58) Field of Classification Search ..... 55/423; 96/156, 157, 408–412; 210/167.14; 60/336; 417/434

See application file for complete search history.

(56) References Cited

U.S. PATENT DOCUMENTS

| | | | | |
|---|---|---|---|---|
| 3,912,629 | A * | 10/1975 | Sonoda | 210/114 |
| 4,892,569 | A | 1/1990 | Kojima | |
| 5,172,714 | A | 12/1992 | Kobayashi et al. | |
| 5,421,360 | A | 6/1995 | Castaneda et al. | |
| 5,555,732 | A | 9/1996 | Whiticar | |
| 5,564,401 | A * | 10/1996 | Dickson | 123/573 |
| 5,942,105 | A | 8/1999 | Leis | |
| 5,983,919 | A | 11/1999 | Ottinger et al. | |
| 6,012,485 | A | 1/2000 | Connelly et al. | |
| 6,083,381 | A | 7/2000 | Connelly et al. | |
| 6,142,174 | A | 11/2000 | Nichols-Roy | |
| 6,161,529 | A * | 12/2000 | Burgess | 123/572 |
| 6,164,500 | A | 12/2000 | Abe et al. | |
| 6,287,370 | B1 | 9/2001 | Kanazawa | |
| 6,338,471 | B1 | 1/2002 | Imsdahl et al. | |
| 6,557,536 | B2 * | 5/2003 | Burgess | 123/572 |
| 6,626,201 | B1 | 9/2003 | Kim | |
| 6,649,048 | B2 | 11/2003 | de Ridder et al. | |
| 6,907,869 | B2 * | 6/2005 | Burgess et al. | 123/572 |
| 7,171,976 | B2 | 2/2007 | Joo et al. | |
| 7,257,942 | B2 * | 8/2007 | Schmeichel et al. | 60/283 |
| 7,278,259 | B2 * | 10/2007 | Schmeichel et al. | 60/283 |
| 7,607,289 | B2 * | 10/2009 | Schmeichel et al. | 60/283 |
| 2001/0054418 | A1 * | 12/2001 | Burgess | 123/572 |
| 2004/0112347 | A1 * | 6/2004 | Hakansson | 123/572 |
| 2004/0173193 | A1 * | 9/2004 | Burgess et al. | 123/573 |

(Continued)

FOREIGN PATENT DOCUMENTS

EP 0526811 B1 12/1997

(Continued)

*Primary Examiner* — Duane Smith
*Assistant Examiner* — Sonji Turner
(74) *Attorney, Agent, or Firm* — Cantor Colburn LLP

(57) ABSTRACT

A turbomachine includes a compressor portion having an intake and a filtration system having an interior and an exterior. The filtration system is arranged upstream of the intake and includes a drain capable of fluid communication with the exterior of the filtration system. The drain includes a one-way valve that allows liquid separated from air flowing through the interior of the filtration system to pass through the drain to the exterior of the filtration system in a first direction, and substantially limits a flow of unfiltered air from entering the intake from the exterior in a second direction.

9 Claims, 4 Drawing Sheets

U.S. PATENT DOCUMENTS

| | | | |
|---|---|---|---|
| 2007/0169448 | A1 | 7/2007 | Osborne et al. |

FOREIGN PATENT DOCUMENTS

| | | | |
|---|---|---|---|
| EP | 1308567 | B1 | 2/2005 |
| EP | 1394372 | B1 | 11/2007 |
| JP | 05-118496 | | 5/1993 |
| JP | 2002-213317 | | 7/2002 |
| WO | 9305336 | | 3/1993 |
| WO | 0050148 | | 8/2000 |
| WO | 2006054088 | A1 | 5/2006 |

* cited by examiner

TURBOMACHINE FILTER SYSTEM HAVING A DRAIN WITH ONE-WAY VALVE

BACKGROUND

Exemplary embodiments of the invention relate to the art of turbomachine inlet filter systems and, more particularly, to a drain for a turbomachine inlet filter system.

Modern turbomachines include a number of rotating components that operate within tight tolerances. Foreign matter ingested into an intake of the turbomachine can cause damage, excessive wear, or even catastrophic failure. Thus, turbomachines are provided with various systems that function to remove foreign particulate from intake airstreams. In general, geographical constraints dictate particulate removal levels for the turbomachines. Turbomachines operating in a relatively dry, clean environment require a lower level of particulate removal as compared to turbomachines operating in harsh environments such as, off-shore oil rigs. In addition to removing particulate, turbomachines are provided with filtration systems that remove moisture from intake airstreams. The liquid can carry chemicals such as salts, acids and the like which could damage internal turbomachine components. Once captured, the moisture is passed to a drain and guided away from the turbomachine.

Existing moisture systems employ a manometric drain that includes a drain box. The drain box is periodically filled with fluid (water) that forms a trap preventing a flow of unfiltered air from bypassing a filtration system and entering the turbomachine intake. More specifically, when in operation, a high velocity airflow enters the turbomachine. The high velocity airflow passes across the drain creating a pressure differential that can pull in additional, unfiltered, air thereby defeating the purpose of the filtration system. In order to prevent the backflow of air, the drain box is partially filled with water to form a trap. However, over time, the water in the drain box dissipates and requires replenishment. Unfortunately, maintenance schedules are not always strictly followed and the water in the drain box is often not replenished in time. In such situations, and despite a large capital investment in filtration systems, unfiltered air enters the turbomachine.

BRIEF DESCRIPTION

In accordance with one exemplary embodiment of the invention, a turbomachine includes a compressor portion having an intake and a filtration system having an interior and an exterior. The filtration system is arranged upstream of the intake and includes a drain capable of fluid communication with the exterior of the filtration system. The drain includes a one-way valve that allows liquid separated from air flowing through the interior of the filtration system to pass through the drain to the exterior of the filtration system in a first direction, and substantially limits a flow of unfiltered air from entering the intake from the exterior in a second direction.

In accordance with another exemplary embodiment of the invention, method of operating a turbomachine includes passing an airflow through a filtration system arranged upstream of a turbomachine intake, capturing liquid from the airflow in the filtration system, and draining the liquid from the filtration system through a drain capable of fluid communication with an exterior of the filtration system. The drain having a one-way valve that allows liquid captured by the filtration system to pass to the exterior in one direction and prevents unfiltered air from entering the turbomachine intake in another direction.

DETAILED DESCRIPTION

Figure 1:
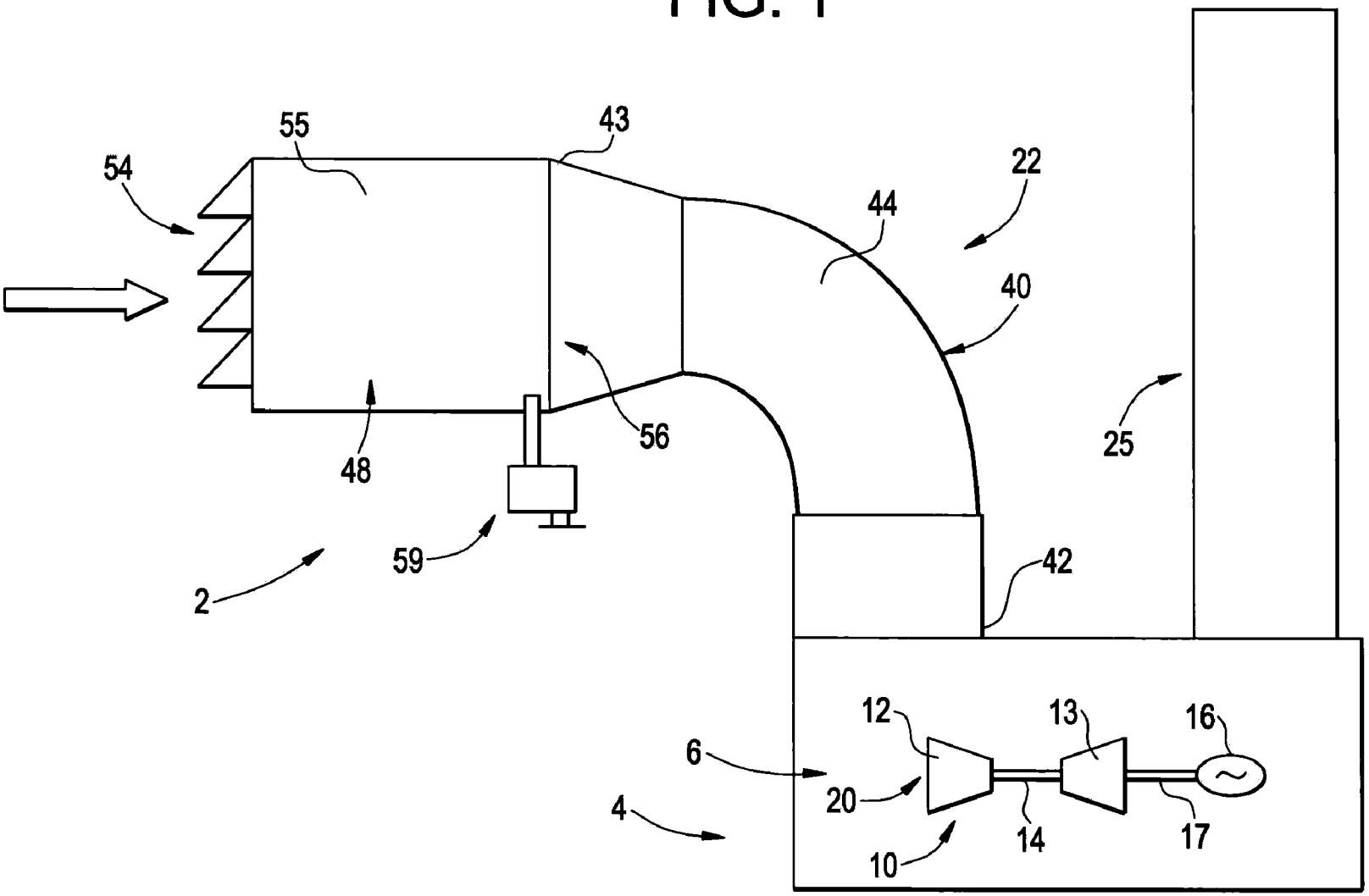
FIG. 1 is a schematic diagram of a turbomachine system including a manometric drain in accordance with an exemplary embodiment of the invention.

With reference to FIG. 1, a turbomachine system, constructed in accordance with exemplary embodiments of the invention, is indicated generally at 2. Turbomachine system 2 includes a turbomachine housing 4 having an interior portion 6 within which is arranged a turbomachine 10. Turbomachine 10 includes a compressor portion 12 that is operatively connected to a turbine portion 13 via a shaft 14 which, in turn, is connected to a generator 16 via a shaft 17. Compressor portion 12 includes an intake 20 that receives a flow of air through an intake system 22. Exhaust gases generated by turbomachine 10 pass from turbomachine housing 4 via an exhaust system 25.

In accordance with the exemplary embodiment shown, intake system 22 includes an intake member or duct 40 having a first end portion 42 that extends from turbomachine housing 4 to a second end portion 43 through an intermediate portion 44. Second end portion 43 is fluidly connected to a filter or filtration system 48 which, depending on geographical constraints, removes various substances such as, particulate of various sizes, moisture, and the like from the flow of air passing into intake 20. Towards that end, filtration system 48 includes an inlet region 54 that receives a flow of "unclean" air, an interior or filtration region 55 for removing foreign objects/moisture, and an outlet region 56 that delivers "clean" or "filtered" air to intake 20. In addition, filtration system 48 includes a manometric drain system 59 positioned adjacent outlet region 56. Manometric drain system 59 provides a pathway for directing any trapped moisture to an exterior of filtration system 48 and away from turbomachine 10. More specifically, manometric drain system 59 allows moisture separated from the airflow passing through filtration system 48 to flow in one direction, i.e., to flow out from filtration system 48, and substantially restricts air from flowing in another direction, i.e., to flow into filtration system 48. In this manner, manometer drain system substantially limits unfiltered air bypassing filtration system 48 and entering intake 20.

Figure 2:
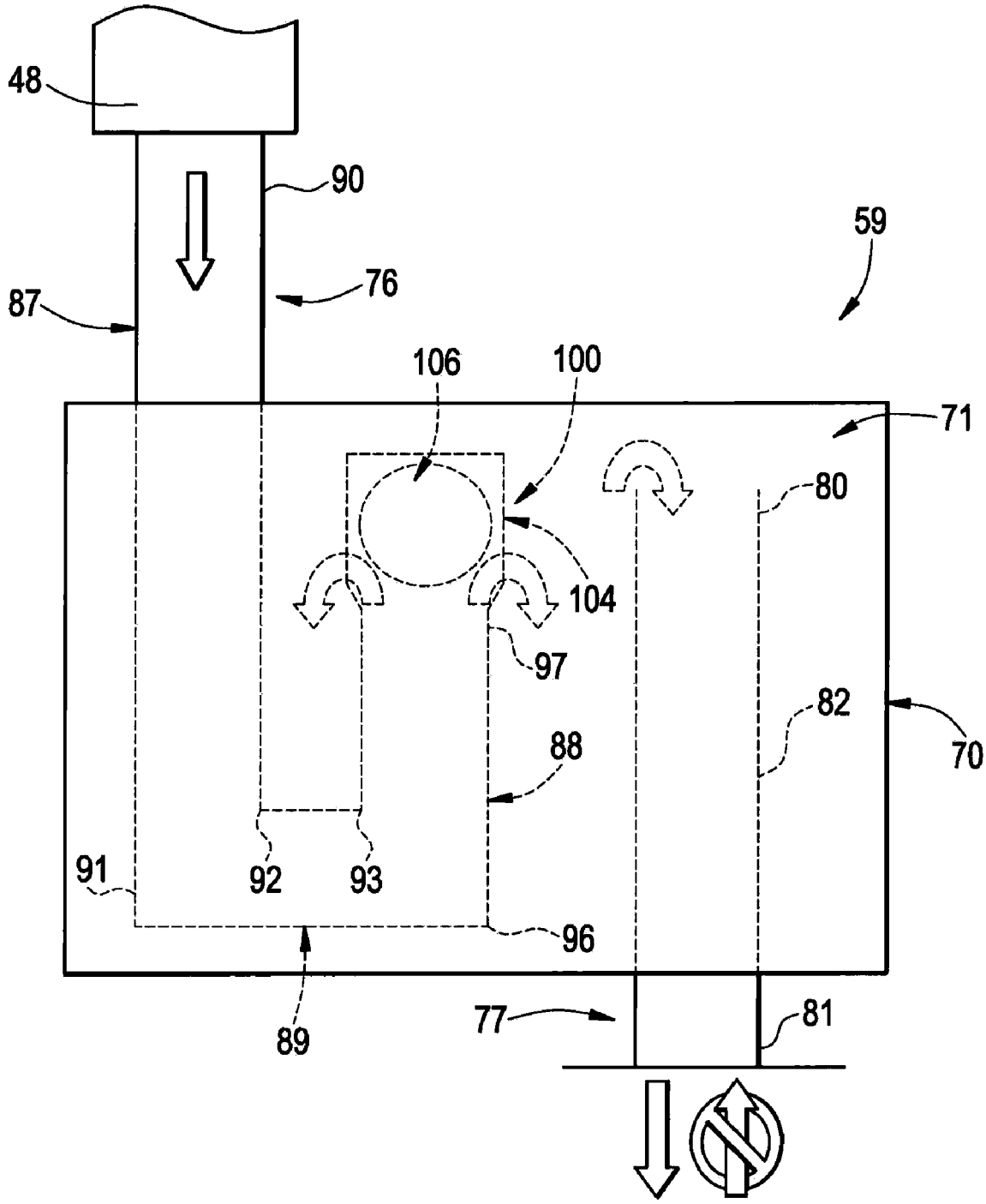
FIG. 2 is a schematic diagram of the manometric drain of FIG. 1.

In operation, turbomachine 10 creates a low pressure area at outlet region 56 that can draw in "unclean" or "unfiltered" air through an open drain. Air passing in through the open drain bypasses particle and moisture filters and can cause damage to internal turbomachine components. Thus, manometric drain system 59 is designed to prevent, or at least substantially limit, the "unclean" or "unfiltered" air from entering intake member 40, bypassing filtration system 48 and potentially causing damage to turbomachine 10. In accordance with one exemplary embodiment illustrated in FIG. 2, manometric drain system 59 includes a drain box 70 having an interior portion or liquid chamber 71. Manometric drain system 59 further includes a first drain tube 76 and a second drain tube 77. Second drain tube 77 includes a first end section 80, exposed within liquid chamber 71, which extends to a second end section 81, through an intermediate section 82. In contrast, first drain tube 76 is generally U-shaped in cross-section and includes a first substantially vertical member 87 that is fluidly connected to a second substantially vertical member 88 through a substantially horizontal member 89.

As shown, first substantially vertical member 87 includes a first end 90, fluidly connected to filtration system 48, that extends to a second end 91. Substantially horizontal member 89 includes a first end 92, fluidly connected to second end 91 of first substantially vertical member 87, that extends to a second end 93. Second substantially vertical member 88 includes a first end 96, fluidly connected to second end 93 of substantially horizontal member 89, which extends to a second end 97 that is selectively exposed to liquid chamber 71. More specifically, first drain tube 76 includes a one-way valve 100 arranged at second end 97 of second substantially vertical member 88. In accordance with the exemplary embodiment shown, one-way valve 100 includes a cage 104 that houses a buoyant member such as, a check ball, 106 that selectively exposes first drain tube 76 to liquid chamber 71.

One-way valve 100 allows moisture/fluid to pass to an exterior of filtration system 48 in one direction while preventing, or at least substantially limiting, un-filtered air from flowing in another, e.g., opposite direction and entering turbomachine 10. More specifically, when liquid chamber 71 includes a sufficient volume of liquid, second end 97 of second substantially vertical member 88 is submerged forming a trap in first drain tube 76. The trap prevents air from flowing through second drain tube 77 and entering turbomachine 10. In contrast, when an inadequate volume of liquid is present within liquid chamber 71, and a liquid trap is not possible, check ball 106 rests against second end 97 of second substantially vertical member 88 blocking flow through first drain tube 76 to prevent turbomachine 10 from ingesting un-filtered air. Of course, any liquid flowing from filtration system 48 will raise or float check ball 106 within cage 104 and allow the liquid to pass into liquid chamber 71. In this manner, in the event that a maintenance schedule is missed, and an inadequate volume of water is present within liquid chamber 71, turbomachine 10 remains protected from foreign objects/debris/moisture.

Figure 3:
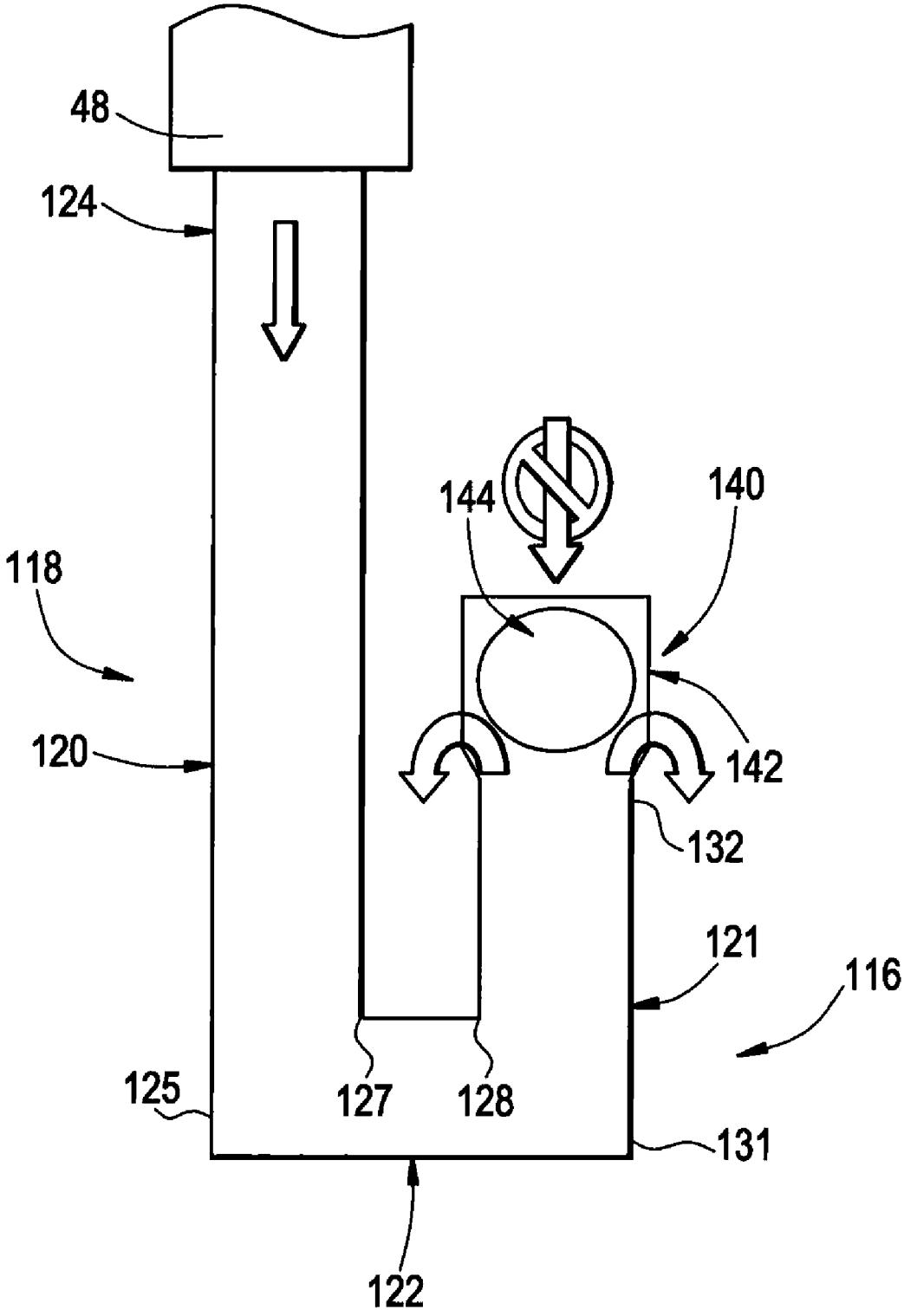
FIG. 3 is a schematic diagram of a manometric drain in accordance with another exemplary embodiment of the invention.

Reference will now be made to FIG. 3 in describing a manometric drain system 116 constructed in accordance with another exemplary embodiment of the invention. As shown, drain system 116 includes a drain tube 118 that is substantially U-shaped in cross-section. In a manner similar to that described above, drain tube 118 includes a first substantially vertical member 120 fluidly connected to a second substantially vertical member 121 through a substantially horizontal member 122. First substantially vertical member 120 includes a first end 124, fluidly connected to filtration system 48, that extends to a second end 125. Substantially horizontal member 122 includes a first end 127, fluidly connected to second end 125 of first substantially vertical member 120, that extends to a second end 128. Second substantially vertical member 121 includes a first end 131, fluidly connected to second end 128 of substantially horizontal member 122, that extends to a second end 132 that is selectively exposed to a drain line (not shown). More specifically, drain tube 118 includes a one-way valve 140 arranged at second end 132 of second substantially vertical member 121. In accordance with the exemplary embodiment shown, one-way valve 140 includes a cage 142 that houses a buoyant check ball 144. In a manner similar to that described above, one-way valve 140 allows moisture/fluid to pass to an exterior of filtration system 48 in one direction while preventing, or at least substantially limiting, un-filtered air from flowing in another, e.g., opposite direction and entering turbomachine 10 via drain tube 118.

Figure 4:
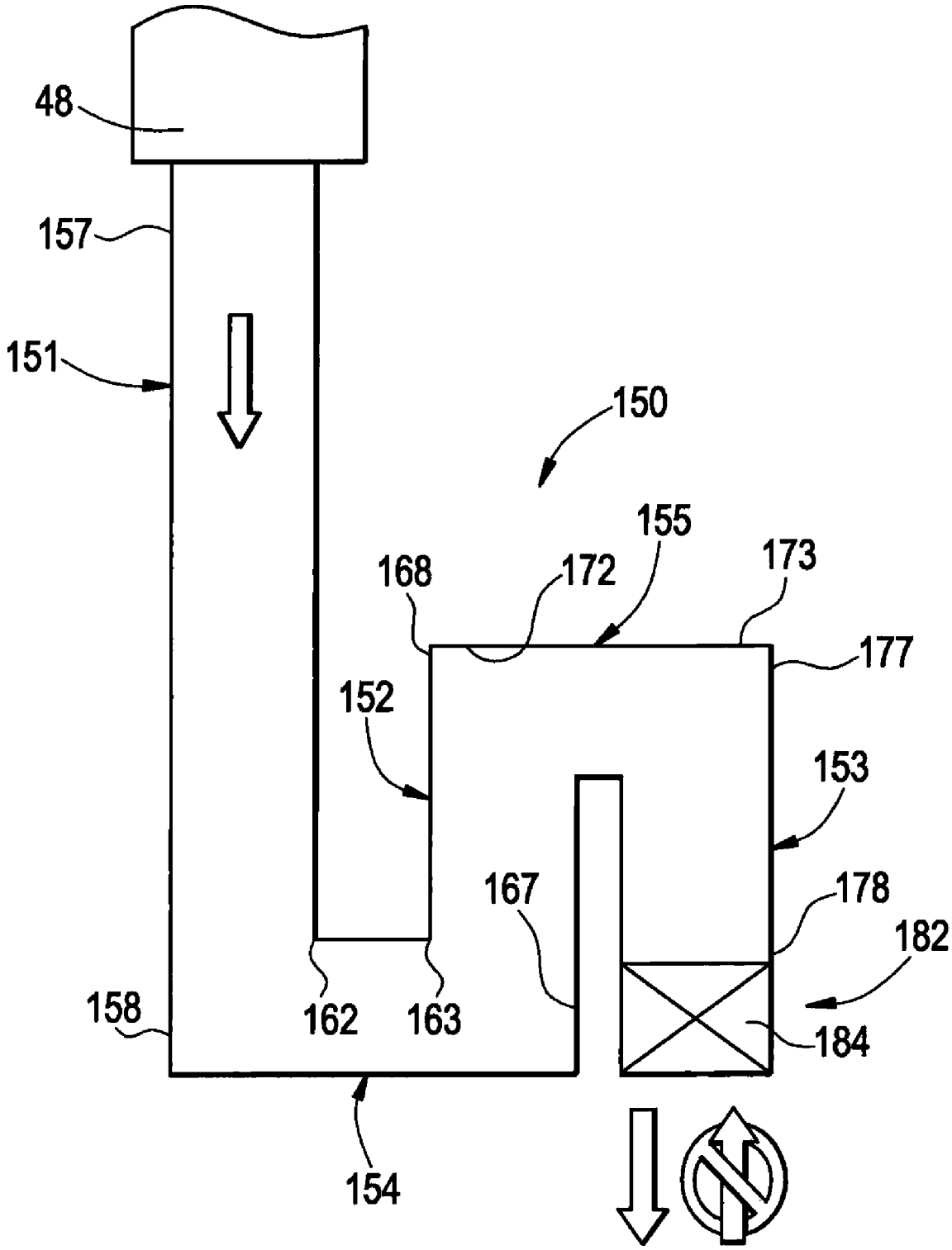
FIG. 4 is a schematic diagram of a manometric drain in accordance with yet another exemplary embodiment of the invention.

Reference will now be made to FIG. 4 in describing a manometric drain system 150 constructed in accordance with yet another exemplary embodiment of the invention. As shown, manometric drain system 150 includes a first substantially vertical member 151 fluidly connected to a second substantially vertical member 152 and a third substantially vertical member 153 by a first substantially horizontal member 154 and a second substantially horizontal member 155 respectively. More specifically, first substantially vertical member 151 includes a first end 157, fluidly connected to filtration system 48, that extends to a second end 158. First substantially horizontal member 154 includes a first end 162, fluidly connected to second end 158 of first substantially vertical member 151, that extends to a second end 163. Second substantially vertical member 152 includes a first end 167 fluidly connected to second end 163 of first substantially horizontal member 154, that extends to a second end 168. Second substantially horizontal member 155 includes a first end 172, fluidly connected to second end portion 168 of second substantially vertical member 152, that extends to a second end 173. Finally, third substantially vertical member 153 includes a first end 177, fluidly connected to second end 173 of second substantially horizontal member 155, that extends to a second end 178.

In accordance with the exemplary embodiment illustrated in FIG. 4, second end 178 is provided with a one-way valve 182. In a manner also similar to that described above, one-way valve 182 allows moisture/fluid to pass to an exterior of filtration system 48 in one direction while preventing, or at least substantially limiting, un-filtered air from flowing in another, e.g., opposite direction and entering turbomachine 10. Towards the end, one-way valve 182 comprises a mechanical check valve 184 that can take the form of a spring-biased check valve, a hydraulic check valve, a diaphragm check valve, a swing check valve or the like.

At this point it should be realized that manometric drain systems constructed in accordance with the above described exemplary embodiments are relatively maintenance free systems that require little attention to ensure proper protection for an associated turbomachine. That is, in contrast to existing systems which require regular inspection and maintenance to ensure that a sufficient volume of liquid is present within the drain system to block incoming unfiltered air. The above described exemplary embodiments include a one-way valve that eliminates the need for the volume of water in a drain box to prevent the ingestion of un-filtered air. Moreover, exemplary embodiments of the invention provide a drain system that eliminates any need for a drain box.

In general, this written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of exemplary embodiments of the invention if they have structural elements that do not differ from the literal language of the claims, or if they include equivalent structural elements with insubstantial differences from the literal language of the claims.

The invention claimed is:

1. A turbomachine comprising:

a compressor portion having an intake;

a filtration system having an interior and an exterior, the filtration system being arranged upstream of the intake and including a drain capable of fluid communication with the exterior of the filtration system, the drain including a one-way valve fluidly connected to the intake, the one-way valve allowing liquid separated from air flowing through the interior of the filtration system to pass through the drain to the exterior of the filtration system in a first direction, and substantially limiting a flow of unfiltered air from entering the intake from the exterior in a second direction.

2. The turbomachine according to claim 1, wherein the one-way valve is a buoyant check ball.

3. The turbomachine according to claim 2, wherein the drain includes a cage, the buoyant check ball being arranged within the cage.

4. The turbomachine according to claim 1, wherein the one-way valve is a mechanical check valve.

5. The turbomachine according to claim 4, wherein the mechanical check valve is one of a spring-biased check valve, a hydraulic check valve, a diaphragm check valve and a swing arm check valve.

6. The turbomachine according to claim 1, wherein the drain comprises a manometric drain including at least one drain tube having a substantially U-shaped cross-section.

7. The turbomachine according to claim 6, wherein the at least one drain tube includes a first substantially vertical member fluidly connected to a second substantially vertical member by a substantially horizontal member, the one-way valve being arranged at one of the first and second substantially vertical members.

8. The turbomachine according to claim 6, wherein the at least one drain tube includes a first drain tube having a first exposed end and a second drain tube having a second exposed end, the first drain tube having a substantially U-shaped cross-section.

9. The turbomachine according to claim 8, wherein each of the first and second exposed ends are arranged within a drain box.

* * * * *